United States Patent [19]

Latham

[11] Patent Number: 4,530,301

[45] Date of Patent: Jul. 23, 1985

[54] VARIABLE CAMBER AIR-FOIL FOR A VESSEL

[76] Inventor: Ronald D. Latham, Rte. 3, Box 184-A, Apex, N.C. 27502

[21] Appl. No.: 574,857

[22] Filed: Jan. 30, 1984

[51] Int. Cl.[3] ..... B63H 9/04

[52] U.S. Cl. ..... 114/102; 114/103; 244/219

[58] Field of Search ..... 114/39, 102, 103; 244/123, 206, 219, DIG. 1

[56] References Cited

U.S. PATENT DOCUMENTS

| | | | |
|---|---|---|---|
| 4,341,176 | 7/1982 | Orrison | 114/102 |
| 4,418,632 | 12/1983 | Yoshimi | 114/102 |
| 4,437,426 | 3/1984 | Latham | 114/39 |

*Primary Examiner*—Trygve M. Blix
*Assistant Examiner*—C. T. Bartz
*Attorney, Agent, or Firm*—Mills & Coats

[57] ABSTRACT

The present invention entails a variable camber airfoil assembly mounted on a vessel and having a pivotably mounted rigid leading edge member. The rigid leading edge member includes an elongated generally V-shaped member that extends substantially the entire length or height of the airfoil assembly. A mast forms a part of said airfoil assembly and extends between a tip member and a root member and wherein said leading edge member is mounted forwardly of the mast. Extending between said tip member and root member rearwardly of the mast is a flexible cable. The variable camber feature of the present invention is formed by a pliable skin having two opposed sides that are interconnected between the leading edge member and the flexible cable. To limit the extent of pivotable movement of the leading edge member, the mast is extended between two sides thereof that form its general V-shape. By the provision of the leading edge member being pivotable, it is appreciated that the same can easily pivot with respect to the boat or vessel for a more effective and efficient entry into the wind.

9 Claims, 2 Drawing Figures

VARIABLE CAMBER AIR-FOIL FOR A VESSEL

FIELD OF INVENTION

The present invention relates to boats and vessels and more particularly to a boat having an airfoil assembly that acts to power the boat through the water.

BACKGROUND OF THE INVENTION

It is known to mount a wing type airfoil on a boat to utilize the force of the wind against the airfoil to power or drive the boat though water. Wing type airfoil assemblies offer numerous advantages over the conventional sail. Among the advantages one can realize from the wing type airfoil as contrasted to a conventional sail is that the wing type airfoil is easy to handle and rig. Generally, the entire airfoil assembly can be quickly removed from the vessel or mounted to the vessel without requiring a great deal of time and effort as is often the case with a conventional sail. In addition, the basic design of a wing type airfoil for a vessel can be of a size that can be handled by one individual.

There is a need, however, to improve the effectiveness and efficiency of conventional wing type airfoils and to design the same such that it can be economically and practically manufactured.

SUMMARY AND OBJECTS OF THE PRESENT INVENTION

The present invention provides an efficient wing type airfoil adapted to be mounted to a boat. Specifically, the improved wing type airfoil of the present invention includes a rigid leading edge member that is designed to improve the efficiency of the airfoil. To accomplish this, the rigid leading edge member is pivotly mounted about the leading edge of the airfoil such that it can move from side to side in order to improve the entry of the airfoil into the wind.

It is therefore an object of the present invention to provide a wing type airfoil for a boat or vessel that includes a rigid predetermined shape.

Another object of the present invention resides in the provision of a wing type airfoil for a boat wherein the wing type airfoil includes a rigid leading edge member that is movably mounted for side movement in order that the same can move to different positions as the direction of the boat or wind changes so as to form a more efficient and effective variable camber airfoil.

Still a further object of the present invention resides in the provision of an airfoil assembly for a boat of the character referred to above where there is provided means for limiting the side to side movement of said leading edge member.

Another object of the present invention resides in the provision of a variable camber wing type airfoil assembly for use in conjunction with a boat wherein the means for limiting side to side movement of said rigid leading edge member comprises a mast that extends substantially the entire length or height of said wing type airfoil and which extends between two laterally spaced sides that forms said rigid leading edge member.

A further object of the present invention is to provide a wing type airfoil of the character referred to above specifically adapted to be used in conjuction with a boat or vessel wherein the wing type airfoil assembly is provided with a styrofoam type material that gives the entire airfoil assembly buoyant properties in order that the same may readily float.

Other objects and advantages of the present invention will become apparent from a study of the following description and the accompanying drawings which are merely illustrative of the present invention.

VARIABLE CAMBER AIRFOIL ASSEMBLY FOR VESSEL

Figure 1:
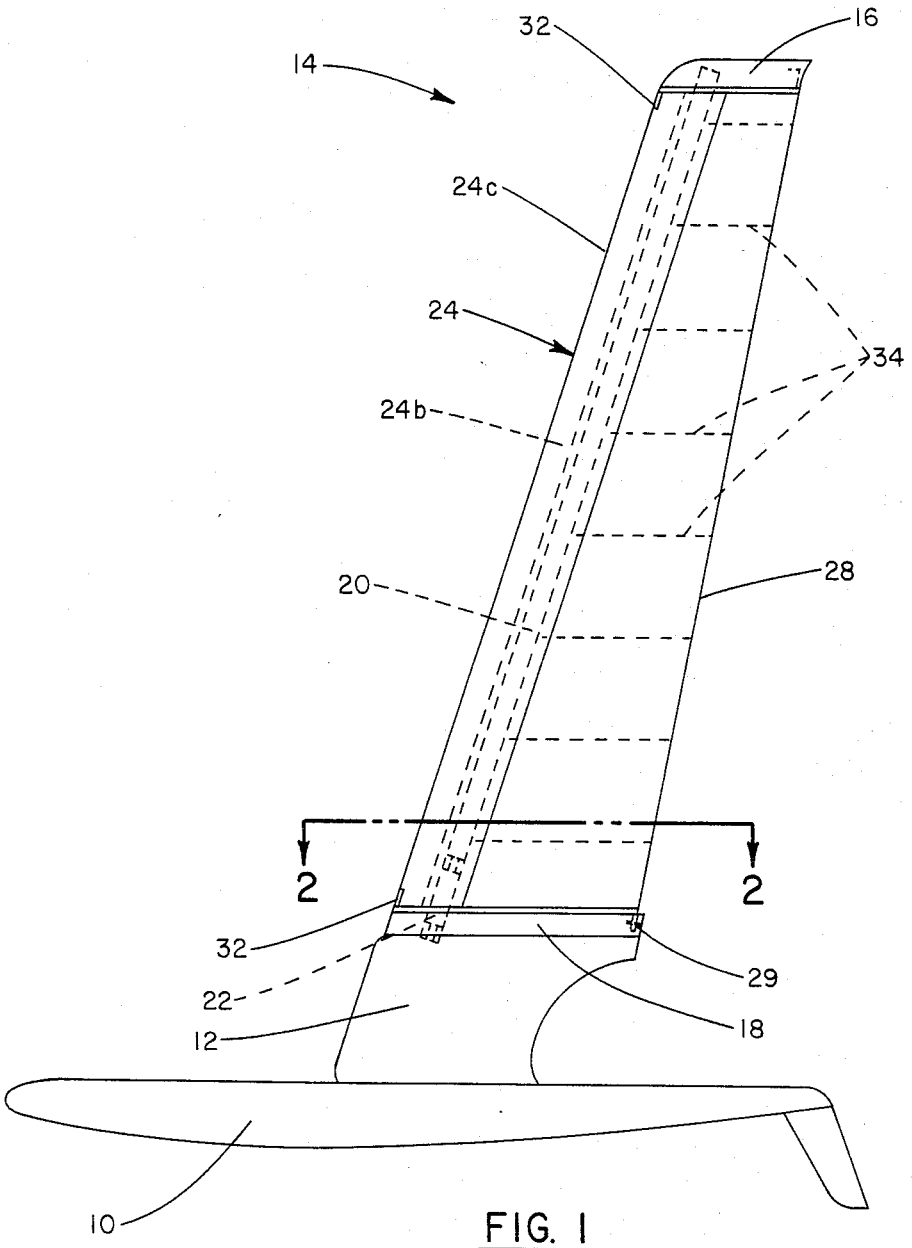
FIG. 1 is a side elevational view of the wing type airfoil assembly of the present invention mounted on a boat.

With further reference to the drawings, the variable camber airfoil assembly of the present invention is shown therein in conjunction with a boat or vessel having a hull indicated by the numeral 10. Forming a part of boat hull 10 is an upwardly extending pylon 12 that is designed to accept and support the wing type airfoil assembly of the present invention which is indicated generally by the numeral 14.

Viewing wing type airfoil assembly 14 in more detail, it is seen that the same includes a tip member 16 and a root member 18. As oriented in the drawings tip member 16 and root member 18 are disposed in vertically spaced apart relationship.

Tip member 16 and root member 18 are integrally connected together by a mast 20 that interconnects therebetween.

Extending upwardly from pylon 12 is a mast holder 22. Lower end of mast 20 is provided with the cylindrical hollow opening that enables the lower portion of mast 20 to be inserted onto mast holder 22 such that mast holder 22 supports mast 20 and the entire wing type airfoil assembly 14.

Extending between tip member 16 and root member 18 about the forward portion of wing type airfoil assembly 14 is a rigid leading edge member 24. Leading edge member 24 is pivotally connected about opposite ends by swivel means or pivot pins 32 that are secured to the respective tip and root members 16 and 18 respectively.

Figure 2:
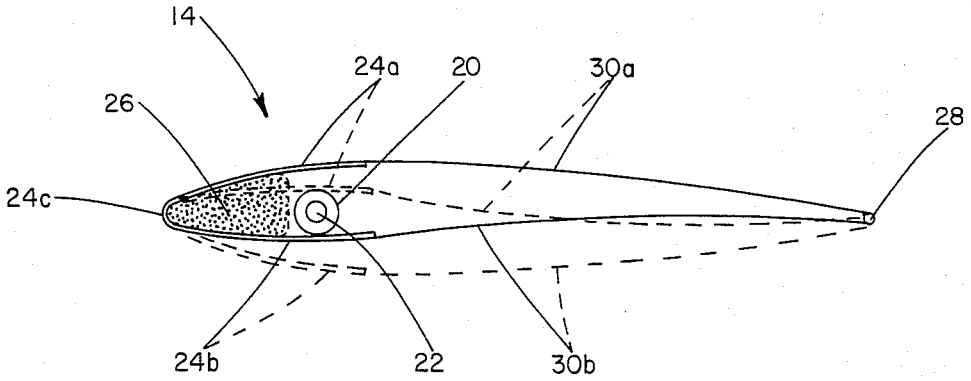
FIG. 2 is a cross-sectional view of the wing type airfoil taken along line 2—2 in FIG. 1.

As illustrated in the drawings, particularly FIG. 2, leading edge member 24 is generally V-shaped and as such includes a pair of laterally spaced apart sides **24*a* and 24*b* that extend forwardly and converge to form a leading edge 24*c***. Herein the rigid leading edge member has been referred to as generally V-shaped. It is appreciated, however, that such reference is merely for convenience as the leading edge may be deemed to be generally U-shaped as well. Essentially the leading edge member will include a leading edge and a pair of spaced apart sides extending therefrom.

From FIG. 2 it is seen that the position of leading edge member 24 is so positioned that the same generally extends past mast 20. In this design, it thusly appreciated that mast 20 serves as a stop since the entire leading edge member 24 can pivot back and forth about an elongated axis formed by pivot pins 32.

Formed internally within V-shaped leading edge member 24 is a foam type core 26 constructed of styrofoam or other similar types of material that has the capability to give the leading edge member 24 and the entire wing type airfoil assembly 14 buoyant properties as well as serving to strengthen the leading edge member 24.

Interconnected between tip and root members 16 and 18 about the rear end of wing type airfoil assembly 14 is a flexible cable 28. To tension flexible cable 28 there is provided a tension adjustment mechanism 29 that is operatively inner connected between flexible cable 28 and root member 18. It is appreciated that tensioning cable 28 causes the leading edge member 24 to also be held in tension and this counters the tension in rear cable 28, and thereby tends to maintain the mast 20 straight.

To form the variable camber for airfoil assembly 14, a dual sided skin is secured about leading edge member 24 and is extended rearwardly therefrom where the same extends to and attaches about rear cable 28. It is appreciated that the skin 30 forms a two-sided, 30*a* and 30*b*, variable camber wing surface. It is appreciated that the skin material can be choosen from dacron, unidirectional fiber Kevlar, or any other normal said fabric. In this same regard, it should be noted that various materials may be utilized in constructing leading edge member 24. For example, leading edge member 24 can be constructed of aluminum or fiberglass.

To impart some degree of rigidity to skin 30, there is provided a series of battens 34 secured within respective sides of the skin 30 forming variable camber wing type airfoil assembly 14.

In operation, with a port wind the leading edge member 24 will swing to lee and stop against mast 20. This will induce an increase of curvature or camber to the lee surface and an accompanying redirection in camber on the port or windward surface. The skin will continue the leading edge camber on the lee side back to the trailing edge which is formed by flexible cable 28 and will slacken and allow an under camber on the port surface of the skin on the windward surface. This results in an efficient low speed wing section which will produce high thrusts in a 2 to 30 knot wind condition. It should be pointed out that the above discussed conditions will reverse themselves in a starboard wind, allowing the wing to be used on the sailing craft on any tack.

It is thusly appreciated that rigid leading edge member 24 gives the entire wing type airfoil assembly 14 a rigid leading edge that has the capability of moving from side to side so as to always provide a predetermined shape for good entry into the wind. Because of the design feature that allows rigid leading edge member 24 to move from side to side, it is appreciated that this will provide a very efficient entry into the wind.

The present invention may, of course, be carried out in other specifc ways than those herein set forth without departng from the spirit and essential characteristics of the invention. The present embodiments are, therefore, to be considered in all respects as illustrative and not restrictive and all changes coming within the meaning and equivalency range of the appended Claim are intended to be embraced therein.

What is claimed is:

1. A vessel including a wing type airfoil with a rigid leading edge member that is movable independently of a mast and which is mounted on said vessel for powering said vessel through water therein said wing type airfoil comprises:

a. a stationary elongated mast having upper and lower portions;

b. a tip member mounted to the top portion of said mast;

c. a root member secured to the lower portion of said mast;

d. rear connecting means disposed rearwardly of said mast and extending between said tip member and said root member;

e. an elongated vertical rigid leading edge member disposed generally forwardly of said stationary mast and extending vertically between said tip and root members and adjacent said mast throughout a substantial portion of its height;

f. said rigid leading edge member including a leading edge and a pair of spaced apart sides that extend rearwardly from said leading edge toward said mast wherein said sides include terminal rear edges that terminate forwardly of said rear connecting means so as to define a space between said terminal rear edges of said leading edge member and said rear connecting means;

g. a skin covering operatively interconnected between said rigid leading edge member and said rear connecting means and including first and second opposite pliable sides that extend from said rigid leading edge member and said rear terminal edges thereof to where they connect with said rear connecting means to effectively form a variable camber wing portion; and h. mounting means associated with said wing type airfoil assembly independent of said mast for movably mounting said leading edge member and the sides thereof for side to side movement relative to said stationary mast, and wherein said leading edge member and said skin covering form an integral airfoil wing assembly having a rigid leading edge and a pliable variable camber wing portion extending rearwardly from the rear terminal edges of said rigid leading edge member and wherein said rigid leading edge member enables the leading edge of the wing type airfoil assembly to assume a predetermined shape for efficient and effective entry into the wind.

2. The wing type airfoil assembly for powering said vessel, as recited in claim 1, further including stop means operatively associated with said rigid leading edge member for limiting the side to side movement of said rigid leading edge member.

3. The wing type airfoil assembly for powering said vessel, as recited in claim 2, wherein said stop means includes said stationary mast and wherein said mast is positioned in said wing type airfoil assembly such that it extends between said sides of said leading edge member such that as said leading edge member moves from side to side, the respective sides thereof engage said mast.

4. The wing type airfoil assembly for powering said vessel as recited in claim 1, wherein said rigid leading edge member includes a generally V-shaped cross section and wherein said rigid leading edge member extends vertically between said tip and root members.

5. The wing type airfoil assembly for powering said vessel, as recited in claim 1, wherein said mounting means for movably mounting said leading edge member includes a pair of pivot pins, one pivot pin being secured to said tip member and forwardly of said mast and the other pivot pin being secured to said root member forwardly of said mast, and wherein said rigid leading edge member includes means for receiving said pivot pins so as to pivotly mount said leading edge member about said pivot pins for pivotable movement thereabout.

6. The wing type airfoil assembly for powering said vessel, as recited in claim 5, wherein said rear connecting means extending between said tip and root members including a flexible line.

7. The wing type airfoil assembly for powering said vessel, as recited in claim 1, wherein said wing type airfoil assembly includes flotation material secured within said leading edge member between the sides thereof.

8. A vessel including a wing type airfoil with a movable rigid leading edge member movably mounted adjacent of a mast and mounted on said vessel for powering said vessel through water wherein said wing type airfoil comprises:

a. an elongated stationary mast having upper and lower portions;

b. a tip member mounted to the top portion of said mast;

c. a root member secured to the lower portion of said mast;

d. rear connecting means disposed rearwardly of said mast and extending between said tip member and said root member;

e. a generally V-shaped elongated rigid leading edge member disposed generally forwardly of said mast and which extends vertically between said root and tip members and adjacent said mast throughout a substantial portion of its height;

f. said rigid leading edge member including a leading edge and a pair of spaced apart sides that extend rearwardly from said leading edge toward and past said mast so as to define an open space therebetween such that said mast extends upwardly between said pair of spaced apart sides and through said open space formed thereby such that said sides can freely move from side to side about said mast;

g. said sides of said leading edge member including rear terminal edges that terminate forwardly of said rear connecting means so as to define a space therebetween;

h. stop means forming a part of said wing type airfoil for limiting the side to side pivotable movement of said leading edge member, said stop means being formed by said mast which is positioned to engage the sides of said leading edge member as the latter moves from side to side;

i. a skin covering operatively interconnected between said rigid leading edge member and said rear connecting means and including first and second opposite pliable sides that extend from said rigid leading edge member and said rear terminal edges thereof to where they connect with said rear connecting means to effectively form a variable camber wing portion; and j. mounting means associated with said wing type airfoil assembly independent of said mast for movably mounting said leading edge member and the sides thereof for side to side movement relative to said stationary mast, and wherein said leading edge member and said skin covering from an integral airfoil wing assembly having a rigid leading edge and a pliable variable camber wing portion extending rearwardly from the rear terminal edges of said rigid leading edge member and wherein said rigid leading edge member enables the leading edge of the wing type airfoil assembly to assume a predetermined shape for efficient and effective entry into the wind.

9. A vessel including a wing type airfoil with a rigid leading edge member that is movable independently of a mast and which is mounted on said vessel for powering said vessel through water wherein said wing type airfoil comprises:

a. a stationary elongated mast having upper and lower portions;

b. a tip member mounted to the top portion of said mast;

c. a root member secured to the lower portion of said mast;

d. rear connecting means disposed rearwardly of said mast and extending between said tip member and said root member;

e. an elongated vertical rigid leading edge member disposed generally forwardly of said stationary mast and extending vertically between said tip and root members and adjacent said mast throughout a substantial portion of its height;

f. flotation material secured vertically within said leading edge member between the sides thereof for enabling said wing type airfoil to float;

g. said rigid leading edge member including a leading edge and a pair of spaced apart sides that extend rearwardly from said leading edge toward said mast wherein said sides include terminal rear edges that terminate forwardly of said rear connecting means so as to define a space between said terminal rear edge of said leading edge member and said rear connecting means;

h. a skin covering operatively interconnected between said rigid leading edge member and said rear connecting means and including first and second opposite pliable sides that extend from said rigid leading edge member and said rear terminal edges thereof to where they connect with said rear connecting means to effectively form a variable camber wing portion; and i. mounting means associated with said wing type airfoil assembly independent of said mast for movably mounting said leading edge member and the sides thereof for side to side movement relative to said stationary mast, and wherein said leading edge member and said skin covering form an integral airfoil wing assembly having a rigid leading edge and a pliable variable camber wing portion extending rearwardly from the rear terminal edges of said rigid leading edge member and wherein said rigid leading edge member enables the leading edge of the wing type airfoil assembly to assume a predetermined shape for efficient and effective entry into the wind.

* * * * *